US008906833B2

(12) United States Patent
Matsui

(10) Patent No.: US 8,906,833 B2
(45) Date of Patent: Dec. 9, 2014

(54) LUBRICANT COMPOSITION

(75) Inventor: Shigeki Matsui, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 25 days.

(21) Appl. No.: 13/055,637

(22) PCT Filed: Jul. 6, 2009

(86) PCT No.: PCT/JP2009/062299

§ 371 (c)(1),
(2), (4) Date: Jan. 24, 2011

(87) PCT Pub. No.: WO2010/010807

PCT Pub. Date: Jan. 28, 2010

(65) Prior Publication Data

US 2011/0124536 A1 May 26, 2011

(30) Foreign Application Priority Data

Jul. 25, 2008 (JP) ..... 2008-192165

(51) Int. Cl.
*C10M 169/04* (2006.01)
*C10M 145/14* (2006.01)
*C10M 171/02* (2006.01)

(52) U.S. Cl.
CPC ..... *C10M 169/04* (2013.01); *C10M 171/02* (2013.01); *C10M 2203/1006* (2013.01); *C10M 2203/1025* (2013.01); *C10M 2203/1065* (2013.01); *C10M 2207/289* (2013.01); *C10M 2209/084* (2013.01); *C10M 2215/102* (2013.01); *C10M 2217/023* (2013.01); *C10M 2219/068* (2013.01); *C10N 2220/021* (2013.01); *C10N 2220/022* (2013.01); *C10N 2220/024* (2013.01); *C10N 2230/02* (2013.01); *C10N 2230/04* (2013.01); *C10N 2230/54* (2013.01); *C10N 2230/74* (2013.01); *C10N 2240/10* (2013.01)
USPC ..... 508/110; 508/469

(58) Field of Classification Search
CPC ..... C10M 171/02; C10M 145/14
USPC ..... 508/110, 469
See application file for complete search history.

(56) References Cited

U.S. PATENT DOCUMENTS

| | | | | |
|---|---|---|---|---|
| 6,642,189 | B2 * | 11/2003 | Kurihara et al. | 508/364 |
| 6,713,438 | B1 * | 3/2004 | Baillargeon et al. | 508/463 |
| 2003/0104955 | A1 * | 6/2003 | Yuki et al. | 508/469 |
| 2006/0211586 | A1 * | 9/2006 | Huang et al. | 508/591 |
| 2007/0032392 | A1 | 2/2007 | Yokoyama et al. | |
| 2007/0191239 | A1 | 8/2007 | Matsuoka et al. | |
| 2008/0110799 | A1 | 5/2008 | Matsui et al. | |

FOREIGN PATENT DOCUMENTS

| | | | |
|---|---|---|---|
| CN | 101065469 | A | 10/2007 |
| JP | 06-306384 | A | 11/1994 |
| JP | 08-302378 | A | 11/1996 |
| JP | 2001-279287 | A | 10/2001 |
| JP | 2002-129182 | A | 5/2002 |
| JP | 2006-117852 | A | 5/2006 |
| JP | 2006-117853 | A | 5/2006 |
| JP | 2006-117854 | A | 5/2006 |
| JP | 2007-045850 | A | 2/2007 |
| JP | 2007-217494 | A | 8/2007 |
| JP | 2008-120909 | A | 5/2008 |
| WO | 2006/043709 | A1 | 4/2006 |

* cited by examiner

*Primary Examiner* — Prem C Singh
*Assistant Examiner* — Francis C Campanell
(74) *Attorney, Agent, or Firm* — Sughrue Mion, PLLC

(57) ABSTRACT

The lubricant base oil of the invention has excellent energy-conserving performance, low-temperature viscosity characteristics, and detergency. The composition contains: (A) a lubricant base oil composed of, based on the total base oil amount, 50 to 99.9 mass % of a lubricant base oil having a 100° C. kinematic viscosity of 1 to less than 5 $mm^2/s$, and 0.1 to 50 mass % of a lubricant base oil having a 100° C. kinematic viscosity of 5 to 200 $mm^2/s$, and (B) a viscosity index improver having average Mw of not less than 10000, and a Mw to PSSI ratio of not lower than $0.8\times10^4$, wherein the composition contains 0.1 to 50 mass % of component (B) based on the total composition amount, and has a 100° C. kinematic viscosity of 3 to 15 $mm^2/s$ and a 150° C. to 100° C. HTHS viscosity ratio of not less than 0.50.

3 Claims, No Drawings

LUBRICANT COMPOSITION

This application is a National Stage of International Application No. PCT/JP2009/062299 filed Jul. 6, 2009, claiming priority based on Japanese Patent Application No. 2008-192165 filed Jul. 25, 2009, the contents of all of which are incorporated herein by reference in their entirety.

The present invention relates to a lubricant composition.

Lubricants have conventionally been used for smoothing the functions of internal combustion engines, transmissions, and other machinery. Lubricants for internal combustion engines are particularly required to have advanced performance with the progress of engine performance, output, and severity of operating conditions. In order to meet such performance requirements, various additives, such as anti-wear agents, metal detergents, ashless dispersants, and anti-oxidants, are contained in conventional engine oils (see, for example, Patent Publications 1 to 3). On the other hand, energy-conserving performance required of lubricants has recently been becoming higher and higher. In order to cope with this, use of base oils with high-viscosity index or various friction modifiers has being discussed (see, for example, Patent Publication 4).

Patent Publication 1: JP-2001-279287-A

Patent Publication 2: JP-2002-129182-A

Patent Publication 3: JP-8-302378-A

Patent Publication 4: JP-6-306384-A

However, conventional lubricant base oils and viscosity index improvers are not always satisfactory in the light of energy-conserving performance and low-temperature viscosity characteristics.

As a common technique for energy conservation, there is known to reduce the kinematic viscosity and to improve the viscosity index of products, that is, multigrading by combining reduction of base oil viscosity and addition of viscosity index improvers. However, there is concern that reduction of product viscosity or base oil viscosity may deteriorate the lubricating performance under severe conditions, such as high-temperature, high-shear conditions, and cause troubles, such as wear, seizure, and fatigue failure.

In order to prevent such troubles and maintain the durability, it is necessary to maintain the high-temperature, high shear viscosity (HTHS viscosity) at 150° C. That is, in order to provide energy-conserving performance while maintaining other practical performances, it is important to reduce the 40° C. and 100° C. kinematic viscosity and the 100° C. HTHS viscosity, while the 150° C. HTHS viscosity is maintained at a certain level, to thereby improve the viscosity index.

As a solution to these problems, it has been found out that the energy-conserving performance and the low-temperature viscosity characteristics may be provided at the same time at high levels by the use of a lubricant composition which contains, based on the total amount of the lubricant composition, 0.1 to 50 mass % of a viscosity index improver having a weight average molecular weight of not less than 10000 and a ratio of the weight average molecular weight to the PSSI (permanent shear stability index) of not lower than $0.8\times10^4$, and which has a ratio of the 150° C. HTHS viscosity to the 100° C. HTHS viscosity of not lower than 0.50. However, it has been revealed that this lubricant composition is inferior in detergency under high-temperature, low-lubricating conditions, in particular, anti-coking property.

Deterioration of detergency may result in deposits or sludge in the engine, and even troubles such as engine stop, at the worst. Thus it is important not only to satisfy both the energy-conserving performance and the low-temperature viscosity characteristics, but also to improve detergency.

It is an object of the present invention to provide a lubricant composition which is excellent in energy-conserving performance, low-temperature viscosity characteristics, and high-temperature detergency, which has remarkably reduced 40° C. and 100° C. kinematic viscosity and 100° C. HTHS viscosity, which affect the improvement in fuel efficiency, while the 150° C. HTHS viscosity is maintained at a certain level, and also which is excellent in anti-coking property.

According to the present invention, there is provided a lubricant composition comprising:

(A) a lubricant base oil consisting of, based on the total amount of the base oil, 50 to 99.9 mass % of a lubricant base oil having a 100° C. kinematic viscosity of not less than 1 and less than 5 $mm^2/s$, and 0.1 to 50 mass % of a lubricant base oil having a 100° C. kinematic viscosity of 5 to 200 $mm^2/s$, and (B) a viscosity index improver having a weight average molecular weight of not less than 10000 and a ratio of the weight average molecular weight to the PSSI of not lower than $0.8\times10^4$, wherein said lubricant composition comprises 0.1 to 50 mass % of said viscosity index improver (B) based on the total amount of the composition, and has a 100° C. kinematic viscosity of 3 to 15 $mm^2/s$, and a ratio of a 150° C. HTHS viscosity to a 100° C. HTHS viscosity of not lower than 0.50.

The lubricant composition of the present invention, containing component (B) blended into component (A) and having the particular properties, has excellent energy-conserving performance, low-temperature viscosity characteristics, and high-temperature detergency, as well as remarkably reduced 40° C. and 100° C. kinematic viscosity and 100° C. HTHS viscosity, which contribute to improvement of energy conservation, and superior anti-coking property.

The present invention will now be explained in detail with reference to preferred embodiments.

The lubricant composition according to the present invention contains a lubricant base oil consisting of a lubricant base oil having a 100° C. kinematic viscosity of not less than 1 and less than 5 $mm^2/s$ (sometimes referred to as base oil (A-1) hereinbelow) and a lubricant base oil having a 100° C. kinematic viscosity of 5 to 200 $mm^2/s$ (sometimes referred to as base oil (A-2) hereinbelow), as a lubricant base oil (sometimes referred to as base oil (A) hereinbelow).

As used herein, the 100° C. kinematic viscosity is defined in ASTM D-445.

The 100° C. kinematic viscosity of base oil (A-1) must be not less than 1 and less than 5 $mm^2/s$. The 100° C. kinematic viscosity is preferably not higher than 4.5 $mm^2/s$, more preferably not higher than 4.3 $mm^2/s$, still more preferably not higher than 4.1 $mm^2/s$, and particularly preferably not higher than 4.0 $mm^2/s$. A 100° C. kinematic viscosity of base oil (A-1) of 5 $mm^2/s$ or higher may impair the viscosity-temperature characteristics, and tend to cause not only failure to provide the desired energy-conserving performance, but also insufficient low-temperature viscosity characteristics. On the other hand, the 100° C. kinematic viscosity of base oil (A-1) is preferably not lower than 1 $mm^2/s$, more preferably not lower than 2 $mm^2/s$, still more preferably not lower than 3 $mm^2/s$, and the most preferably not lower than 3.5 $mm^2/s$. A 100° C. kinematic viscosity of base oil (A-1) of less than 1 $mm^2/s$ tends to cause insufficient oil film formation at a lubricating site to lower the lubricity. Also the evaporation loss of the lubricant base oil tends to be increased.

Base oil (A-1) may be one or a combination of two or more base oils, as long as each base oil fulfills a 100° C. kinematic viscosity of not less than 1 and less than 5 $mm^2/s$.

The viscosity index of base oil (A-1) is not particularly limited, and may preferably be not less than 100, more preferably not less than 120, still more preferably not less than 125, particularly preferably not less than 130, and most preferably not less than 135; and preferably not more than 180, more preferably not more than 170, still more preferably not more than 160, and particularly preferably not more than 150. If the viscosity index is less than the aforementioned lower limit, not only the energy-conserving performance and the low-temperature viscosity characteristics are inferior, but also the thermal and oxidation stability and the resistance to volatilization tend to be poor. If the viscosity index exceeds the aforementioned upper limit, the low-temperature viscosity characteristics are severely impaired.

As used herein, the viscosity index is measured in accordance with JIS K 2283-1993.

The 15° C. density ($\rho_{15}$) of base oil (A-1) is not particularly limited, and may preferably be not higher than $\rho$ represented by formula (a), i.e., $\rho_{15} \leq \rho$:

$$\rho = 0.0025 \times kv100 + 0.816 \quad (a)$$

wherein kv100 is a 100° C. kinematic viscosity ($mm^2/s$) of base oil (A).

If $\rho_{15} > \rho$, the viscosity-temperature characteristics and the thermal and oxidation stability, as well as the resistance to volatilization and the low-temperature viscosity characteristics are poor, and the energy-conserving performance may be deteriorated. In addition, the effectiveness of additives, when added to base oil (A), may be reduced.

The 15° C. density ($\rho_{15}$) of base oil (A-1) is preferably not higher than 0.860, more preferably not higher than 0.850, still more preferably not higher than 0.840, particularly preferably not higher than 0.822.

As used herein, the 15° C. density is the density measured at 15° C. in accordance with JIS K 2249-1995.

The pour point of base oil (A-1) is not particularly limited, and may preferably be not higher than −10° C., more preferably not higher than −12.5° C., still more preferably not higher than −15° C., particularly preferably not higher than −17.5° C., and most preferably not higher than −20° C. If the pour point exceeds the aforementioned upper limit, the low-temperature fluidity of the entire lubricant oil tends to be lowered.

As used herein, the pour point is measured in accordance with JIS K 2269-1987.

The aniline point (AP(° C.)) of base oil (A-1) is not particularly limited, and may preferably be not lower than (A) represented by formula (b), i.e., AP≥A:

$$(A) = 4.3 \times kv100 + 100 \quad (b)$$

wherein kv100 is a 100° C. kinematic viscosity ($mm^2/s$) of base oil (A).

If AP<(A), the viscosity-temperature characteristics and thermal and oxidation stability, as well as the resistance to volatilization and the low-temperature viscosity characteristics are poor, and the effectiveness of additives, when added to base oil (A-1), may be reduced.

The iodine value of base oil (A-1) is not particularly limited, and may preferably be not more than 7, more preferably not more than 5, still more preferably not more than 3, particularly preferably not more than 1, still particularly preferably not more than 0.5, and most preferably not more than 0.2. The iodine value may be less than 0.001, but in view of small corresponding effect and economic efficiency, the iodine value may preferably be not less than 0.001, more preferably not less than 0.01, still more preferably not less than 0.03, and particularly preferably not less than 0.05. Smaller iodine values of base oil (A-1) will drastically improve the thermal and oxidation stability.

As used herein, the iodine value is determined by the indicator titration method provided in JIS K 0070 "Acid Value, Saponification Value, Ester Value, Iodine Value, Hydroxyl Value, and Unsaponifiable Matter of Chemical Products".

The Noack evaporation loss of base oil (A-1) is not particularly limited, and may preferably be not more than 20 mass %, more preferably not more than 15 mass %, still more preferably not more than 10 mass %, particularly preferably not more than 9 mass %, and most preferably not more than 8 mass %. Noack evaporation loss of not more than the aforementioned upper limit will result in low volatility and improved detergency. On the other hand, the Noack evaporation loss may preferably be not less than 1 mass %, more preferably not less than 3 mass %, still more preferably not less than 5 mass %. Noack evaporation loss of less than the aforementioned lower limit will cause not only failure to provide the desired energy-conserving performance, but also deterioration of the low-temperature viscosity characteristics.

As used herein, the Noack evaporation loss is an evaporation loss as determined in accordance with ASTM D 5800-95 (conditions for measurement: 250° C., 1 hour).

The % $C_A$ of base oil (A-1) is not particularly limited, and may preferably be not more than 5, more preferably not more than 2, still more preferably not more than 1, and particularly preferably not more than 0.5. With % $C_A$ of base oil (A-1) exceeding the aforementioned upper limit, the viscosity-temperature characteristics, the thermal and oxidation stability, and the friction characteristics tend to be impaired. The % $C_A$ of base oil (A-1) may be 0, but by making the % $C_A$ above the aforementioned lower limit, solubility of additives may further be increased.

The % $C_P$ of base oil (A-1) is not particularly limited, and may usually be not less than 70, preferably not less than 80, more preferably not less than 85, still more preferably not less than 87, and particularly preferably not less than 90; and preferably not more than 99, more preferably not more than 95, still more preferably not more than 94, and particularly preferably not more than 93. With % $C_P$ of base oil (A-1) of less than the aforementioned lower limit, the viscosity-temperature characteristics and the thermal and oxidation stability tend to be impaired, whereas with % $C_P$ of base oil (A) exceeding the aforementioned upper limit, solubility of additives tends to be lowered, and detergency impaired.

The % $C_N$ of base oil (A-1) is not particularly limited, and may usually be not more than 30, preferably not more than 25, more preferably not more than 15, still more preferably not more than 10, and particularly preferably not more than 8; and preferably not less than 3, more preferably not less than 4, still more preferably not less than 5, and particularly preferably not less than 6. With % $C_N$ of base oil (A-1) exceeding the aforementioned upper limit, the viscosity-temperature characteristics, the thermal and oxidation stability, and the friction characteristics tend to be impaired, whereas with % $C_N$ of less than the aforementioned lower limit, solubility of additives tends to be lowered, and detergency impaired.

As used herein, % $C_P$, % $C_N$, and % $C_A$ are percentage of the paraffin carbon number, the naphthene carbon number, and the aromatic carbon number, respectively, to the total carbon number as determined in accordance with ASTM D 3238-85 (n-d-M ring analysis). That is, the aforementioned preferred ranges of % $C_P$, % $C_N$, and % $C_A$ are based on the values determined by the above method, and, for example, even when base oil (A-1) is free of a naphthene fraction, the % $C_N$ determined by the above method could be more than 0.

The content of the saturated components in base oil (A-1) is not particularly limited, and may preferably be not less than 90 mass %, more preferably not less than 95 mass %, and still more preferably not less than 99 mass % of the total amount of the base oil. The proportion of the cyclic saturated components in the aforementioned saturated components may preferably be not more than 40 mass %, more preferably not more than 35 mass %, still more preferably not more than 30 mass %, particularly preferably not more than 25 mass %, and most preferably not more than 21 mass %. The content of the saturated components and the proportion of the cyclic saturated components therein meeting the aforementioned conditions will improve the viscosity-temperature characteristics and the thermal and oxidation stability.

As used herein, the saturated components are determined by the method provided in ASTM D 2007-93.

Separation of the saturated components, or composition analysis of the cyclic saturated components, the non-cyclic saturated components, and the like may also be carried out by similar methods which give similar results. For example, aside from the aforementioned method, a method provided in ASTM D 2425-93 or ASTM D 2549-91, a method utilizing high performance liquid chromatography (HPLC), or improvements thereof, may be employed.

The aromatics in base oil (A-1) are not particularly limited, and their content may preferably be, based on the total amount of the base oil, not more than 5 mass %, more preferably not more than 2 mass %, still more preferably not more than 1 mass %, particularly preferably not more than 0.5 mass %, and most preferably not more than 0.3 mass %; and preferably not less than 0.01 mass %, more preferably not less than 0.05 mass %, still more preferably not less than 0.1 mass %, and particularly preferably not less than 0.15 mass %. The aromatics content above the aforementioned upper limit tends to impair the viscosity-temperature characteristics, the thermal and oxidation stability, and the friction characteristics, as well as the resistance to volatilization and the low-temperature viscosity characteristics. Base oil (A-1) may be free of aromatics, but the aromatics content above the aforementioned lower limit will further improve the solubility of additives.

As used herein, the aromatics are determined in accordance with ASTM D 2007-93, and usually include, in addition to alkylbenzene and alkylnaphthalene, anthracene, phenanthrene, and alkylation products thereof; compounds obtained by condensation of four or more benzene rings; and aromatic compounds having hetero atoms, such as pyridines, quinolines, phenols, and naphthols.

The urea adduct value of base oil (A-1) is preferably not more than 5 mass %, more preferably not more than 3 mass %, still more preferably not more than 2.5 mass %, and particularly preferably not more than 2 mass %, for improved low-temperature viscosity characteristics without detraction of the viscosity-temperature characteristics, and for high thermal conductivity. The urea adduct value of base oil (A-1) may be 0 mass %, but for a lubricant base oil having a sufficient low-temperature viscosity characteristics and a higher viscosity index, as well as good economic efficiency with relaxed dewaxing conditions, the value may preferably be not less than 0.1 mass %, more preferably not less than 0.5 mass %, particularly preferably not less than 0.8 mass %.

As used herein, the urea adduct value is determined by the following method.

100 g of a sample oil (base oil (A-1)) is measured out and placed in a round bottom flask. 20 mg of urea, 360 ml of toluene, and 40 ml of methanol are added, and stirred at room temperature for 6 hours. This gives white granular crystals formed in the reaction liquid as an urea adduct. The reaction liquid is subjected to filtration through a one-micron filter to take the generated white granular crystals out, which are then washed six times with 50 ml of toluene. The white crystals thus obtained are placed in a flask, to which 300 ml of pure water and 300 ml of toluene are added, and stirred at 80° C. for 1 hour. The aqueous phase is removed through a separating funnel, and the toluene phase is washed three times with 300 ml of pure water. A desiccant (sodium sulfate) is added to the toluene phase to do a dehydration treatment, and then toluene is distilled out. The ratio (in mass percent) of the urea adduct thus obtained to the sample oil is defined as the urea adduct value.

In determining the urea adduct value, the components of isoparaffin which adversely affect the low-temperature viscosity characteristics and which impair the thermal conductivity, and normal paraffin, if any, remaining in the lubricant base oil, are precisely and securely scavenged as urea adducts, so that the urea adduct value is an excellent evaluation index of the low-temperature viscosity characteristics and the thermal conductivity of lubricant base oils. Incidentally, the present inventors have confirmed by GC and NMR analyses that the main components of the urea adduct are of normal paraffin and isoparaffin having not less than 6 carbon atoms from a terminal end of the main chain to the branching site.

The 100° C. kinematic viscosity of base oil (A-2) must be 5 to 200 $mm^2/s$. The kinematic viscosity may preferably be not lower than 5.3 $mm^2/s$, more preferably not lower than 5.5 $mm^2/s$, still more preferably not lower than 5.7 $mm^2/s$, and most preferably not lower than 5.9 $mm^2/s$; and preferably not higher than 100 $mm^2/s$, more preferably not higher than 50 $mm^2/s$, still more preferably not higher than 30 $mm^2/s$, particularly preferably not higher than 20 $mm^2/s$, and most preferably not higher than 10 $mm^2/s$. If the 100° C. kinematic viscosity of base oil (A-2) is less than 5 $mm^2/s$, the desired high-temperature detergency may not be provided, whereas if over 200 $mm^2/s$, the viscosity-temperature characteristics are poor, and not only the desired energy-conserving performance cannot be provided, but also the low-temperature viscosity characteristics may be impaired.

The viscosity index of base oil (A-2) is not particularly limited, and may preferably be not less than 80, more preferably not less than 100, still more preferably not less than 120, particularly preferably not less than 130, and most preferably not less than 135; and preferably not more than 180, more preferably not more than 170, still more preferably not more than 160, and particularly preferably not more than 150. If the viscosity index is less than the aforementioned lower limit, not only the energy-conserving performance and the low-temperature viscosity characteristics are inferior, but also the thermal and oxidation stability and the resistance to volatilization tend to be poor. If the viscosity index exceeds the aforementioned upper limit, the low-temperature viscosity characteristics tend to be severely impaired.

The Noack evaporation loss of base oil (A-2) is not particularly limited, and may preferably be not more than 20 mass %, more preferably not more than 15 mass %, still more preferably not more than 10 mass %, particularly preferably not more than 8 mass %, and most preferably not more than 7 mass %. Noack evaporation loss below the aforementioned upper limit may result in low evaporativity and improved detergency. On the other hand, the Noack evaporation loss may preferably be not less than 1 mass %, more preferably not less than 3 mass %, still more preferably not less than 5 mass %. Noack evaporation loss below the aforementioned lower limit may cause not only failure to provide the desired energy-conserving performance, but also deterioration of the low-temperature viscosity characteristics.

The mixing ratio of base oils (A-1) and (A-2) must be 50 to 99.9 mass % of base oil (A-1) and 0.1 to 50 mass % of base oil (A-2) based on the total amount of the base oil. The amount of base oil (A-1) is preferably not more than 99 mass %, more preferably not more than 97 mass %, still more preferably not more than 95 mass %, and most preferably not more than 92 mass %; and preferably not less than 53 mass %, more preferably not less than 60 mass %, still more preferably not less than 70 mass %, and most preferably 80 mass %. The amount of base oil (A-2) is preferably not less than 1 mass %, more preferably not less than 3 mass %, still more preferably not less than 5 mass %, and most preferably not less than 8 mass %; and preferably not more than 47 mass %, more preferably not more than 40 mass %, still more preferably not more than 30 mass %, particularly preferably not more than 25 mass %, and most preferably not more than 20 mass %.

If the mixing proportion of base oil (A-1) is over 99.9 mass %, in other words, if the mixing proportion of base oil (A-2) is less than 0.1 mass %, the desired high-temperature detergency may not be provided, whereas if the mixing proportion of base oil (A-1) is less than 50 mass %, in other words, if the mixing proportion of base oil (A-2) is more than 50 mass %, the viscosity-temperature characteristics are poor, and not only the desired energy-conserving performance may not be provided, but also the low-temperature viscosity characteristics may be impaired.

Each of base oils (A-1) and (A-2) may be a mineral base oil and/or a synthetic base oil.

The mineral base oil may be, for example, paraffin mineral oils refined by atmospheric- and/or vacuum-distilling crude oil, and refining the resulting lubricant fraction by one or a combination of two or more of solvent deasphalting, solvent extraction, hydrocracking, solvent dewaxing, contact dewaxing, hydrorefining, washing with sulfuric acid, and clay treatment; or normal paraffin or isoparaffin base oils.

The synthetic base oil may be, for example, poly-α-olefin or hydrides thereof, isobutene oligomer or hydrides thereof, isoparaffin, alkylbenzene, alkylnaphthalene; diesters, such as ditridecyl glutarate, di-2-ethylhexyl adipate, diisodecyl adipate, ditridecyl adipate, or di-2-ethylhexyl sebacate; polyol esters, such as trimethylolpropane caprylate, trimethylolpropane pelargonate, pentaerythritol-2-ethylhexanoate, or pentaerythritol pelargonate; polyoxyalkylene glycols, dialkyldiphenyl ethers, or polyphenyl ethers. Among these, poly-α-olefin is preferred. Poly-α-olefin may typically be an oligomer or a co-oligomer of α-olefin having usually 2 to 32, preferably 6 to 16 carbon atoms, such as 1-octene oligomer, decene oligomer, ethylene-propylene co-oligomer, or hydrides thereof.

The poly-α-olefin may be prepared by any process without specific limitation, for example, by polymerizing α-olefin in the presence of a polymerization catalyst, such as a Friedel-Crafts catalyst, including a complex of aluminum trichloride or boron trifluoride with water, alcohol, such as ethanol, propanol, or butanol, carboxylic acid, or an ester.

Preferred examples of base oils (A-1) and (A-2) constituting base oil (A) according to the present invention may be those obtained from the following starting material base oils (1) to (8), by refining the starting material oils and/or the lubricant fraction recovered therefrom, through a particular refining process, and recovering the lubricant fraction:

(1) distillate oil obtained by atmospheric distillation of paraffinic and/or mixed-based crude oils;

(2) distillate oil obtained by vacuum-distilling the atmospheric residue of paraffinic and/or mixed-base crude oils (WVGO);

(3) wax obtained by lubricant dewaxing, such as slack wax, and/or synthetic wax produced by gas-to-liquid (GTL) process and the like, such as Fischer-Tropsch wax or GTL wax;

(4) mixed oil of one or more of base oils (1) to (3) and/or mildly-hydrocracked oil of such mixed oil;

(5) mixed oil of two or more of base oils (1) to (4);

(6) deasphalted oil (DAO) of base oil (1), (2), (3), (4), or (5);

(7) mildly-hydrocracked (MHC) oil of base oil (6);

(8) mixed oil of two or more of base oils (1) to (7).

Examples of the aforementioned refining process may include: hydrorefining, such as hydrocracking or hydrofinishing; solvent refining, such as furfural solvent extraction; dewaxing, such as solvent dewaxing or contact dewaxing; clay refining with acid clay or activated clay; and chemical (acid or alkali) refining, such as washing with sulfuric acid or caustic soda. One or any combination of two or more of these refining processes may be employed in the present invention. Two or more of these refining processes may be combined, if desired, in any order, which may suitably be selected without restriction.

Base oils (A-1) and (A-2) constituting base oil (A) of the present invention may particularly preferably be base oil (9) or (10) mentioned below obtained by subjecting a base oil selected from the aforementioned base oils (1) to (8) or the lubricant fraction thereof to particular treatment:

(9) hydrocracked mineral oil obtained by hydrocracking a base oil selected from base oils (1) to (8) or the lubricant fraction thereof, subjecting the resulting product or the lubricant fraction thereof recovered by distillation or the like to dewaxing, such as solvent or contact dewaxing, followed by distillation,

(10) hydroisomerized mineral oil obtained by hydroisomerizing a base oil selected from base oils (1) to (8) or the lubricant fraction thereof, subjecting the resulting product or the lubricant fraction thereof recovered by distillation or the like to dewaxing, such as solvent or contact dewaxing, followed by distillation.

In preparing base oil (9) or (10), solvent refining and/or hydrofinishing treatment steps may additionally be performed in suitable steps, as desired.

The catalyst used in the hydrocracking or hydroisomerization is not particularly limited, and may preferably be a hydrocracking catalyst having one or more hydrogenation metals, such as metals of groups VIa and VIII of the periodic table, carried on a support of a composite oxide having cracking activity, such as silica alumina, alumina boria, and silica zirconia, or a combination of one or more of such composite oxides, bound with a binder; or a hydroisomerization catalyst having hydrogenation metals including at least one or more Group VIII metals carried on a support containing zeolite, such as ZSM-5, zeolite beta, or SAPO-11. The hydrocracking catalyst and the hydroisomerization catalyst may be combined by laminating or mixing.

The reaction conditions for hydrocracking or hydroisomerization are not particularly limited, and may preferably be, for example, the hydrogen partial pressure of 0.1 to 20 MPa, average reaction temperature of 150 to 450° C., LHSV of 0.1 to 3.0 $hr^{-1}$, and hydrogen/oil ratio of 50 to 20000 scf/bbl.

The 100° C. kinematic viscosity of base oil (A) in the present invention is not particularly limited, and may usually be not higher than 6 $mm^2/s$, preferably not higher than 5.5 $mm^2/s$, more preferably not higher than 5.2 $mm^2/s$, still more preferably not higher than 5.0 $mm^2/s$, particularly preferably not higher than 4.8 $mm^2/s$, and most preferably not higher than 4.5 $mm^2/s$; and usually not lower than 1 $mm^2/s$, preferably not lower than 1.5 $mm^2/s$, more preferably not lower than 2 $mm^2/s$, still more preferably not lower than 2.5 $mm^2/s$, and particularly preferably not lower than 3 $mm^2/s$. A 100° C. kinematic viscosity of base oil (A) exceeding 6 $mm^2/s$ may impair the low-temperature viscosity characteristics, and cause failure to provide sufficient energy-conserving performance. On the other hand, a 100° C. kinematic viscosity of lower than 1 $mm^2/s$ may result in insufficient oil film formation at the lubricating site, which causes poor lubricity, and severe evaporation loss of the lubricant composition.

The 40° C. kinematic viscosity of base oil (A) is not particularly limited, and may preferably be not higher than 80 $mm^2/s$, more preferably not higher than 50 $mm^2/s$, still more preferably not higher than 30 $mm^2/s$, particularly preferably not higher than 25 $mm^2/s$, and most preferably not higher than 20 $mm^2/s$; and preferably not lower than 6.0 $mm^2/s$, more preferably not lower than 8.0 $mm^2/s$, still more preferably not lower than 12 $mm^2/s$, particularly preferably not lower than 14 $mm^2/s$, and most preferably not lower than 15 $mm^2/s$. A 40° C. kinematic viscosity of base oil (A) exceeding 80 $mm^2/s$ may impair the low-temperature viscosity characteristics, and cause failure to provide sufficient energy-conserving performance. On the other hand, a 40° C. kinematic viscosity of lower than 6.0 $mm^2/s$ may result in insufficient oil film formation at the lubricating site, which causes poor lubricity, and severe evaporation loss of the lubricant composition.

The viscosity index of base oil (A) is not particularly limited, and may preferably be not less than 100, more preferably not less than 120, still more preferably not less than 125, particularly preferably not less than 130, and most preferably not less than 135; and not more than 180, more preferably not more than 170, still more preferably not more than 160, and particularly preferably not more than 150. With a viscosity index of less than the aforementioned lower limit, the energy-conserving performance and the low-temperature viscosity characteristics may be impaired, and the thermal and oxidation stability and the resistance to volatilization tend to be poor. On the other hand, with a viscosity index exceeding the aforementioned upper limit, the low-temperature viscosity characteristics tend to be impaired drastically.

The 15° C. density ($\rho_{15}$) of base oil (A) is not particularly limited, and may preferably be not higher than ρ represented by formula (a), i.e., $\rho_{15} \leq \rho$:

$$\rho = 0.0025 \times kv100 + 0.816 \quad (a)$$

wherein kv100 stands for a 100° C. kinematic viscosity ($mm^2/s$) of base oil (A).

If $\rho_{15} > \rho$, the viscosity-temperature characteristics and the thermal and oxidation stability, as well as the resistance to volatilization and the low-temperature viscosity characteristics are poor, and the energy-conserving performance may be deteriorated. In addition, the effectiveness of additives, when added to base oil (A), may be reduced.

The 15° C. density ($\rho_{15}$) of base oil (A) is preferably not higher than 0.860, more preferably not higher than 0.850, still more preferably not higher than 0.840, and particularly preferably not higher than 0.830.

The pour point of base oil (A) is not particularly limited, and may preferably be not higher than −10° C., more preferably not higher than −12.5° C., still more preferably not higher than −15° C., particularly preferably not higher than −17.5° C., and most preferably not higher than −20° C. If the pour point exceeds the aforementioned upper limit, the low-temperature fluidity of the entire lubricant oil tends to be lowered.

As used herein, the pour point is measured in accordance with JIS K 2269-1987.

The aniline point (AP (° C.)) of base oil (A) is not particularly limited, and may preferably be not lower than (A) represented by formula (b), i.e., AP≥A:

$$(A) = 4.3 \times kv100 + 100 \quad (b)$$

wherein kv100 stands for a 100° C. kinematic viscosity ($mm^2/s$) of base oil (A).

If AP<(A), the viscosity-temperature characteristics and the thermal and oxidation stability, as well as the resistance to volatilization and the low-temperature viscosity characteristics tend to be poor, and the effectiveness of additives, when added to base oil (A), may be reduced.

The iodine value of base oil (A) is not particularly limited, and may preferably be not more than 7, more preferably not more than 5, still more preferably not more than 3, particularly preferably not more than 2, and most preferably not more than 1. The iodine value may be less than 0.01, but in view of small corresponding effect and economic efficiency, the iodine value may preferably be not less than 0.001, more preferably not less than 0.01, still more preferably not less than 0.03, and particularly preferably not less than 0.05. An iodine value of base oil (A) of not more than 7 will drastically improve the thermal and oxidation stability.

As used herein, the iodine value is determined by the indicator titration method provided in JIS K 0070 "Acid Value, Saponification Value, Ester Value, Iodine Value, Hydroxyl Value, and Unsaponifiable Matter of Chemical Products".

The sulfur content of based oil (A) depends on the sulfur content of its starting material. For example, using a substantially sulfur free material, such as a synthetic wax component obtained through Fischer-Tropsch reaction, base oil (A) which is substantially free of sulfur may be obtained. On the other hand, using a sulfur-containing material, such as slack wax obtained in the refining process of a lubricant base oil or microwax obtained in the wax refining process, the sulfur content of the resulting base oil (A) is usually not less than 100 mass ppm.

The sulfur content of base oil (A) is preferably not more than 100 mass ppm, more preferably not more than 50 mass ppm, still more preferably not more than 10 mass ppm, and particularly preferably not more than 5 mass ppm, for further improved thermal and oxidation stability and a lower sulfur content.

The nitrogen content of base oil (A) is not particularly limited, and may preferably be not more than 7 mass ppm, more preferably not more than 5 mass ppm, and still more preferably not more than 3 mass ppm. A nitrogen content exceeding 7 mass ppm tends to lower the thermal and oxidation stability.

As used herein, the nitrogen content is determined in accordance with JIS K 2609-1990.

The % $C_A$ of base oil (A) is not particularly limited, and may preferably be not more than 5, more preferably not more than 2, still more preferably not more than 1, and particularly preferably not more than 0.5. With % $C_A$ of base oil (A) exceeding the aforementioned upper limit, the viscosity-temperature characteristics, the thermal and oxidation stability, and the friction characteristics tend to be poor. The % $C_A$ of base oil (A) may be 0, but by making the % $C_A$ above the aforementioned lower limit, solubility of additives may further be increased.

The % $C_P$ of base oil (A) is not particularly limited, and may usually be not less than 70, preferably not less than 80, more preferably not less than 85, still more preferably not less than 87, and particularly preferably not less than 90; and preferably not more than 99, more preferably not more than 95, still more preferably not more than 94, and particularly preferably not more than 93. With % $C_P$ of base oil (A) of less than the aforementioned lower limit, the viscosity-temperature characteristics and the thermal and oxidation stability tend to be poor, whereas with % $C_p$ of base oil (A) exceeding the aforementioned upper limit, solubility of additives tends to be lowered.

The % $C_N$ of base oil (A) is not particularly limited, and may preferably be not more than 30, more preferably 4 to 25, still more preferably 5 to 13, and particularly preferably 5 to 8. With % $C_N$ of base oil (A) exceeding the aforementioned upper limit, the viscosity-temperature characteristics, the thermal and oxidation stability, and the friction characteristics tend to be poor, whereas with % $C_N$ of less than the aforementioned lower limit, solubility of additives tends to be lowered.

The content of the saturated components in base oil (A) is not particularly limited, and may preferably be not less than 90 mass %, more preferably not less than 95 mass %, and still more preferably not less than 97 mass %, and particularly preferably not less than 98 mass % of the total amount of the base oil. The proportion of the cyclic saturated components in the aforementioned saturated components may preferably be not more than 40 mass %, more preferably not more than 35 mass %, still more preferably not more than 30 mass %, particularly preferably not more than 25 mass %, and most preferably not more than 21 mass %. The content of the saturated components and the proportion of the cyclic saturated components therein meeting the aforementioned condition will improve the viscosity-temperature characteristics and the thermal and oxidation stability.

The aromatics in base oil (A) are not particularly limited, and their content may preferably be not more than 5 mass %, more preferably not more than 4 mass %, still more preferably not more than 3 mass %, and particularly preferably not more than 2 mass %; and preferably not less than 0.1 mass %, more preferably not less than 0.5 mass %, still more preferably not less than 1 mass %, and particularly preferably not less than 1.5 mass %. An aromatics content above the aforementioned upper limit tends to impair the viscosity-temperature characteristics, the thermal and oxidation stability, and the friction characteristics, as well as the resistance to volatilization and the low-temperature viscosity characteristics. Base oil (A) may be free of aromatics, but an aromatics content above the aforementioned lower limit will further improve the solubility of additives.

The urea adduct value of base oil (A) is preferably not more than 5 mass %, more preferably not more than 4 mass %, still more preferably not more than 3 mass %, and particularly preferably not more than 2.5 mass %, for improved low-temperature viscosity characteristics without detraction of the viscosity-temperature characteristics, and for high thermal conductivity. The urea adduct value of base oil (A) may be 0 mass %, but for a lubricant base oil having a sufficient low-temperature viscosity characteristics and a higher viscosity index, as well as good economic efficiency with relaxed dewaxing conditions, the value may preferably be not less than 0.1 mass %, more preferably not less than 0.5 mass %, and particularly preferably not less than 0.8 mass %.

The lubricant composition according to the present invention contains a viscosity index improver having a weight average molecular weight of not less than 10000 and a ratio of the weight average molecular weight to the PSSI of not less than $0.8\times10^4$ (referred to as viscosity index improver (B) hereinbelow), added at a particular ratio to base oil (A).

The viscosity index improver (B) is not particularly limited as long as the weight average molecular weight and the ratio of the weight average molecular weight to the PSSI meet the aforementioned conditions. Specific examples of the viscosity index improver (B) may include non-dispersant or dispersant type poly(meth)acrylates, non-dispersant or dispersant type ethylene-α-olefin copolymers or hydrides thereof, polyisobutylene or hydrides thereof, styrene-diene hydrogenated copolymers, styrene-maleic anhydride ester copolymers, and polyalkyl styrenes, all having the weight average molecular weight of not less than 10000, and the ratio of the weight average molecular weight to the PSSI of not less than $0.8\times10^4$. The viscosity index improver (B) may either be non-dispersant or dispersant type, but the latter is more preferred.

Preferred examples of the viscosity index improver (B) may include those having 1 to 70 mol % of one or more (meth)acrylate structural units represented by formula (1) (referred to as poly(meth)acrylate viscosity index improver (B) for the sake of convenience hereinbelow). In formula (1) below, $R^1$ stands for a hydrogen atom or a methyl group, and $R^2$ stands for a straight or branched hydrocarbon group having not less than 16 carbon atoms.

Poly(meth)acrylate viscosity index improver (B) may either be non-dispersant or dispersant type, but the latter is more preferred.

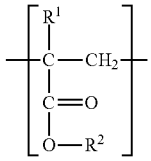

(1)

In the formula (1), $R^1$ stands for a hydrogen atom or a methyl group, and $R^2$ stands for a straight or branched hydrocarbon group having not less than 16 carbon atoms, preferably a straight or branched hydrocarbon group having not less than 18 carbon atoms, more preferably a straight or branched hydrocarbon group having not less than 20 carbon atoms, and still more preferably a branched hydrocarbon group having not less than 20 carbon atoms. The upper limit of the carbon number of $R^2$ is not particularly limited, and is usually not more than 100, preferably not more than 50, more preferably not more than 30, and particularly preferably not more than 25.

In polymeth(acrylate) viscosity index improver (B), the proportion of the (meth)acrylate structural unit represented by formula (1) is preferably 1 to 70 mol %, more preferably not more than 60 mol %, still more preferably not more than 50 mol %, particularly preferably not more than 40 mol %, and most preferably not more than 30 mol %; and preferably not less than 3 mol %, more preferably not less than 5 mol %, and particularly preferably not more than 10 mol %. At over 70 mol %, improvement in viscosity-temperature characteristics, low-temperature viscosity characteristics, and solubility in lubricant base oil may be inferior, whereas at lower than 0.5 mol %, improvement in viscosity-temperature characteristics may be inferior.

Poly(meth)acrylate viscosity index improver (B) may optionally contain (meth)acrylate structural unit other than (meth)acrylate structural unit represented by formula (1), or a structural unit derived from olefins or the like.

Poly(meth)acrylate viscosity index improver (B) may preferably be a copolymer of one or more monomers represented by formula (2) (referred to as monomer (M-1) hereinbelow) and a monomer other than monomer (M-1):

(2)

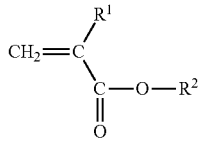

wherein $R^2$ stands for a hydrogen atom or a methyl group, and $R^2$ stands for a straight or branched hydrocarbon group having not less than 16 carbon atoms.

Any monomer may be combined with monomer (M-1), and, for example, a monomer represented by formula (3) (referred to as monomer (M-2) hereinbelow) is preferred. A copolymer of monomers (M-1) and (M-2) constitutes a so-called non-dispersant type poly(meth)acrylate viscosity index improver.

(3)

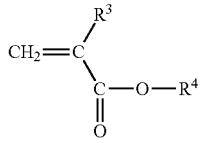

In formula (3), $R^3$ stands for a hydrogen atom or a methyl group, and $R^4$ stands for a straight or branched hydrocarbon group having 1 to 15 carbon atoms.

As the other monomer to be combined with monomer (M-1), one or more of a monomer represented by formula (4) (referred to as monomer (M-3) hereinbelow) and a monomer presented by formula (5) (referred to as monomer (M-4) hereinbelow) are preferred. A copolymer of monomers (M-1) and (M-3) and/or (M-4) constitutes a so-called dispersant type poly(meth)acrylate viscosity index improver. This dispersant type poly(meth)acrylate viscosity index improver may additionally contain monomer (M-2) as a constituent monomer.

(4)

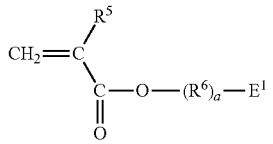

(5)

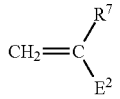

In formula (4), $R^5$ stands for a hydrogen atom or a methyl group, $R^6$ stands for an alkylene group having 1 to 18 carbon atoms, $E^1$ stands for an amine or heterocyclic residue having 1 to 2 nitrogen atoms and 0 to 2 oxygen atoms, and a denotes 0 or 1.

In formula (5), $R^7$ stands for a hydrogen atom or a methyl group, and $E^2$ stands for an amine or heterocyclic residue having 1 to 2 nitrogen atoms and 0 to 2 oxygen atoms.

Specific examples of the alkylene group having 1 to 18 carbon atoms represented by $R^6$ in formula (4) may include ethylene, propylene, butylenes, pentylene, hexylene, heptylene, octylene, nonylene, decylene, undecylene, dodecylene, tridecylene, tetradecylene, pentadecylene, hexadecylene, heptadecylene, and octadecylene groups (these alkylene groups may either be straight or branched).

The group represented by $E^1$ in formula (4) and the group represented by $E^2$ in formula (5) may independently be a dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, pyperidinyl, quinonyl, pyrrolidonyl, pyrrolidono, imidazolino, or pyrazino group.

Preferred examples of monomers (M-3) and (M-4) may include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morphorinoethyl methacrylate, N-vinylpyrrolidone, and mixtures thereof.

The copolymerization molar ratio for a copolymer of monomers (M-1) and (M-2) to (M-4) is not particularly limited, and monomer (M-1): monomer (M-2) to (M-4) is preferably about 0.5:99.5 to 70:30, more preferably 5:95 to 50:50, still more preferably 10:90 to 40:60.

The viscosity index improver (B) may be prepared by any method, and poly(meth)acrylate viscosity index improver (B) may readily be prepared, for example, by radical solvent polymerization of a mixture of monomers (M-1) and (M-2) to (M-4) in the presence of a polymerization initiator such as benzoyl peroxide.

The PSSI of viscosity index improver (B) is not particularly limited, and may preferably be not more than 40, more preferably not more than 35, still more preferably not more than 30, and particularly preferably not more than 25; and preferably not less than 5, more preferably not less than 10, still more preferably not less than 15, and particularly preferably not less than 20. A PSSI of over 40 may impair shear stability, whereas a PSSI of less than 5 may result in little improvement in viscosity index, poor energy-conserving performance and low-temperature viscosity characteristics, as well as increased cost.

As used herein, the PSSI is a permanent shear stability index of a polymer calculated from the data measured in accordance with ASTM D 6278-02 (Test Method for Shear Stability of Polymer Containing Fluids Using a European Diesel Injector Apparatus) with reference to ASTM D 6022-01 (Standard Practice for Calculation of Permanent Shear Stability Index).

The weight average molecular weight ($M_w$) of viscosity index improver (B) must be not less than 10000, more preferably not less than 50000, still more preferably not less than 100000, particularly preferably not less than 150000, and most preferably not less than 200000; and preferably not more than 1000000, more preferably not more than 700000, still more preferably not more than 600000, and particularly preferably not more than 500000. The weight average molecular weight of less than 10000 may result in little improvement in viscosity index, poor energy-conserving performance and low-temperature viscosity characteristics, as well as increased cost, whereas the weight average molecular weight of over 1000000 may impair shear stability, solubility in a base oil, and storage stability.

The ratio of the weight average molecular weight to the number average molecular weight ($M_w/M_n$) of viscosity index improver (B) is not particularly limited, and may preferably be 0.5 to 5.0, more preferably 1.0 to 3.5, still more preferably 1.5 to 3, particularly preferably 1.7 to 2.5. The ratio of the weight- to number-average molecular weight of less than 0.5 or over 5.0 may cause not only poor solubility in a base oil and storage stability, but also impaired viscosity-temperature characteristics and energy-conserving performance.

The ratio of the weight average molecular weight to the PSSI ($M_w$/PSSI) of viscosity index improver (B) must be not less than $0.8\times10^4$, preferably not less than $1.0\times10^4$, more preferably not less than $2\times10^4$, and still more preferably not less than $2.5\times10^4$. A Mw/PSSI of less than $0.8\times10^4$ may impair the viscosity-temperature characteristics and thus the energy-conserving performance.

In the lubricant composition according to the present invention, the content of the viscosity index improver (B) must be 0.1 to 50 mass % of the total amount of the composition, preferably not less than 0.5 mass %, more preferably not less than 1 mass %, particularly preferably not less than 2 mass %, and most preferably not less than 5 mass %; and preferably not more than 40 mass %, more preferably not more than 30 mass %, and particularly preferably not more than 20 mass %. A content of viscosity index improver (B) of less than 0.1 mass % may result in poor improvement in viscosity index and little effect in reducing the product viscosity, and thus failure to improve the energy-conserving performance. On the other hand, a content of more than 50 mass % may drastically increase the product cost, and cause necessity to reduce the base oil viscosity. Thus the lubrication performance under severe lubrication conditions, such as high-temperature, high-shear conditions, may be impaired, resulting in troubles, such as wear, seizure, and fatigue failure.

The lubricant composition according to the present invention may optionally contain, in addition to viscosity index improver (B), other viscosity index improvers, such as commonly used non-dispersant or dispersant type poly(meth) acrylates, non-dispersant or dispersant type ethylene-α-olefin copolymers or hydrides thereof, polyisobutylene or hydrides thereof, styrene-diene hydrogenated copolymers, styrene-maleic anhydride ester copolymers, and polyalkylstyrenes.

The lubricant composition according to the present invention may optionally contain a friction modifier selected from organic molybdenum compounds and ashless friction modifiers, for further improved energy-conserving performance.

Examples of the organic molybdenum compounds may include those containing sulfur, such as molybdenum dithiophosphate and molybdenum dithiocarbamate.

Sulfur-containing organic molybdenum compounds other than these may include a complex of a molybdenum compound and a sulfur-containing or other organic compound, or a complex of a sulfur-containing molybdenum compound, such as molybdenum sulfide or sulfomolybdic acid, and alkenylsuccinimide.

Examples of the molybdenum compounds may include molybdenum oxide, such as molybdenum dioxide or molybdenum trioxide; molybdic acid, such as o-molybdic acid, p-molybdic acid, or sulfurized (poly)molybdic acid; molybdate, such as a metal salt or an ammonium salt of the molybdic acid; molybdenum sulfide, such as molybdenum disulfide, molybdenum trisulfide, molybdenum pentasulfide, or molybdenum polysulfide; sulfurized molybdic acid; a metal salt or an amine salt of sulfurized molybdic acid; molybdenum halide, such as molybdenum chloride.

Examples of the sulfur-containing organic compounds may include alkyl(thio)xanthate, thiadiazole, mercaptothiadiazole, thiocarbonate, tetrahydrocarbyl thiuram disulfide, bis(di(thio)hydrocarbyldithiophosphonate)disulfide, organic (poly)sulfide, and sulfurized esters.

The organic molybdenum compounds may be organic molybdenum compounds which do not contain sulfur as a constituent element.

Examples of the sulfur-free organic molybdenum compounds may include molybdenum-amine complexes, molybdenum-succinimide complexes, molybdenum salts of organic acid, and molybdenum salts of alcohol, of which molybdenum-amine complexes, molybdenum salts of organic acid, and molybdenum salts of alcohol are preferred.

In the lubricant composition according to the present invention, the content of the organic molybdenum compound, if any, is not particularly limited, and may preferably be not less than 0.001 mass %, more preferably not less than 0.005 mass %, still more preferably not less than 0.01 mass %; and preferably not more than 0.2 mass %, more preferably not more than 0.1 mass %, still more preferably not more than 0.05 mass %, and particularly preferably not more than 0.03 mass %, of the total amount of the composition in terms of molybdenum element. At less than 0.001 mass %, the thermal and oxidation stability of the lubricant composition may be insufficient, in particular, long-term maintenance of excellent detergency tends to be difficult. On the other hand, at over 0.2 mass %, proportionate effect to the content cannot be achieved, and the storage stability of the lubricant composition tends to be poor.

The ashless friction modifier may be any compound that is usually used as a friction modifier for lubricants, for example, an amine, amido, imido, or ester compound having in its molecule at least one alkyl or alkenyl group having 6 to 50 carbon atoms, preferably at least one straight alkyl or alkenyl group having 6 to 50 carbon atoms. Further, fatty acid esters, fatty acid amides, fatty acids, aliphatic alcohols, aliphatic ethers, urea friction modifiers may be used as the ashless friction modifier.

In the lubricant composition according to the present invention, the content of the ashless friction modifier, if any, may preferably be, based on the total amount of the composition, not less than 0.01 mass %, more preferably not less than 0.1 mass %, and still more preferably not less than 0.3 mass %; and preferably not more than 3 mass %, more preferably not more than 2 mass %, and still more preferably not more than 1 mass %. At less than 0.01 mass %, the friction reducing effect derived from the addition of the ashless friction modifier will be insufficient, whereas at over 3 mass %, effects of wear resistance additives are likely to be disturbed, or the solubility of additives tends to be impaired.

According to the present invention, either one or both of the organic molybdenum compound and the ashless friction modifier may be used. For longer-term maintenance of the friction reducing effect, use of the ashless friction modifier is more preferred.

The lubricant composition according to the present invention may optionally contain, according to its use, any additives that are commonly used in lubricants, in order to further improve its performance. Such additives may include, for example, metal detergents, ashless dispersants, anti-oxidants, anti-wear agents (or extreme pressure agents), corrosion inhibitors, rust inhibitors, pour point depressants, demulsifiers, metal deactivators, and foam inhibitors.

Examples of the metal detergents may include normal, basic, or overbased salts, such as alkali or alkaline earth metal sulfonates, alkali or alkaline earth metal phenates, and alkali or alkaline earth metal salicylates. According to the present invention, one or more alkali or alkaline earth metal detergents selected from the aforementioned group, in particular, alkaline earth metal detergents may preferably be used. Magnesium and/or calcium salts are particularly preferred, and the latter is more preferred.

The ashless dispersants may be any ashless dispersants used in lubricants, for example, mono- or bissuccinimide having in its molecule at least one straight or branched alkyl or alkenyl group having 40 to 400 carbon atoms, benzylamine having in its molecule at least one alkyl or alkenyl group having 40 to 400 carbon atoms, polyamine having in its molecule at least one alkyl or alkenyl group having 40 to 400 carbon atoms, boron compound derivatives thereof, or derivatives thereof obtained by modification with carboxylic or phosphoric acid. For use, any one or a combination of two or more selected from these may be added.

Examples of the anti-oxidants may include phenol or amine ashless anti-oxidants, and metal anti-oxidants, such as of copper or molybdenum type. Specifically, the phenol ashless anti-oxidants may be, for example, 4,4'-methylenebis(2,6-di-tert-butylphenol) or 4,4'-bis(2,6-di-tert-butylphenol), and the amine ashless anti-oxidants may be, for example, phenyl-α-naphthylamine, alkylphenyl-α-naphthylamine, or dialkyldiphenylamine.

The anti-wear agents (or extreme pressure agents) may be any anti-wear agents or extreme pressure agents used in lubricants, for example, sulfur, phosphorus, or sulfur-phosphorus extreme pressure agents. Specific examples may include phosphite esters, thiophosphite esters, dithiophosphite esters, trithiophosphite esters, phosphate esters, thiophosphate esters, dithiophosphate esters, trithiophosphate esters, amine salts thereof, metal salts thereof, derivatives thereof, dithiocarbamate, zinc dithiocarbamate, molybdenum dithiocarbamate, disulfides, polysulfides, sulfurized olefins, and sulfurized oils and fats. Among these, sulfur extreme pressure agents are preferred, and sulfurized oils and fats are particularly preferred.

Examples of the corrosion inhibitors may include benzotriazole compounds, tolyltriazole compounds, thiadiazole compounds, and imidazole compounds.

Examples of the rust inhibitors may include petroleum sulfonate, alkylbenzene sulfonate, dinonylnaphthalene sulfonate, alkenyl succinate, and polyhydric alcohol esters.

The pour point depressants may be polymethacrylate polymers compatible with the lubricant base oil in use.

Examples of the demulsifiers may include polyalkylene glycol nonionic surfactants, such as polyoxyethylene alkyl ether, polyoxyethylene alkylphenyl ether, and polyoxyethylene alkylnaphthyl ether.

Examples of the metal deactivators may include imidazoline, pyrimidine derivatives, alkylthiadiazole, mercaptobenzothiazole, benzotriazole or derivatives thereof, 1,3,4-thiadiazole polysulfide, 1,3,4-thiadiazolyl-2,5-bisdialkyldithiocarbamate, 2-(alkyldithio)benzoimidazole, and β-(o-carboxybenzylthio)propionitrile.

Examples of the foam inhibitors may include silicone oils having a 25° C. kinematic viscosity of not less than 0.1 and less than 100 $mm^2/s$, alkenyl succinic acid derivatives, esters of polyhydroxy aliphatic alcohol and long-chain fatty acid, and methylsalicylate and o-hydroxybenzyl alcohol.

The content of each of these additives, if any, in the lubricant composition according to the present invention may preferably be 0.01 to 10 mass % of the total amount of the composition.

The 100° C. kinematic viscosity of the lubricant composition according to the present invention must be 3 to 15 $mm^2/s$, preferably not higher than 12 $mm^2/s$, more preferably not higher than 9.3 $mm^2/s$, still more preferably not higher than 8.5 $mm^2/s$, particularly preferably not higher than 7.8 $mm^2/s$, and most preferably not higher than 7.6 $mm^2/s$; and preferably not lower than 4 $mm^2/s$, more preferably not lower than 5 $mm^2/s$, still more preferably not lower than 6 $mm^2/s$, and particularly preferably not lower than 7 $mm^2/s$. A 100° C. kinematic viscosity of less than 3 $mm^2/s$ may cause insufficient lubricity, whereas a 100° C. kinematic viscosity of over 15 $mm^2/s$ may not provide required low-temperature viscosity and sufficient energy-conserving performance.

The 40° C. kinematic viscosity of the lubricant composition according to the present invention is not particularly limited, and may usually be 4 to 80 $mm^2/s$, preferably not higher than 50 $mm^2/s$, more preferably not higher than 45 $mm^2/s$, still more preferably not higher than 40 $mm^2/s$, particularly preferably not higher than 35 $mm^2$, and most preferably not higher than 33 $mm^2$; and preferably not lower than 10 $mm^2/s$, more preferably not lower than 20 $mm^2/s$, still more preferably not lower than 25 $mm^2/s$, and particularly preferably not lower than 27 $mm^2/s$. A 40° C. kinematic viscosity of less than 4 $mm^2/s$ may cause insufficient lubricity, whereas a 40° C. kinematic viscosity of over 80 $mm^2/s$ may not provide required low-temperature viscosity and sufficient energy-conserving performance.

The viscosity index of the lubricant composition according to the present invention is not particularly limited, and may preferably be in the range of 140 to 300, more preferably not less than 190, still more preferably not less than 200, still more preferably not less than 210, and particularly preferably not less than 215. A viscosity index of less than 140 may cause difficulty in improving the energy-conserving performance with the HTHS viscosity being maintained, and also in reducing the low-temperature viscosity at −35° C. On the other hand, a viscosity index of over 300 may impair the low-temperature fluidity, and generate problems caused by insufficient solubility of additives or compatibility with sealing materials.

The 150° C. HTHS viscosity of the lubricant composition according to the present invention is not particularly limited, and may preferably be not higher than 3.5 mPa·s, more preferably not higher than 3.0 mPa·s, still more preferably not higher than 2.8 mPa·s, and particularly preferably not higher than 2.7 mPa·s; and preferably not lower than 2.0 mPa·s, more preferably not lower than 2.1 mPa·s, still more preferably not lower than 2.2 mPa·s, particularly preferably not lower than 2.3 mPa·s, and most preferably not lower than 2.4 mPa·s.

As used herein, the 150° C. HTHS viscosity is a high-temperature, high-shear viscosity at 150° C. as provided in ASTM D4683. A 150° C. HTHS viscosity of less than 2.0 mPa·s may cause insufficient lubricity, whereas a 150° C. HTHS viscosity of over 3.5 mPa·s may not provide required low-temperature viscosity and sufficient energy-conserving performance.

The 100° C. HTHS viscosity of the lubricant composition according to the present invention is not particularly limited, and may preferably be not higher than 5.3 mPa·s, more preferably not higher than 5.2 mPa·s, still more preferably not higher than 5.1 mPa·s, and particularly preferably not higher than 5.0 mPa·s; and preferably not lower than 3.5 mPa·s, more preferably not lower than 3.8 mPa·s, particularly preferably not lower than 4.0 mPa·s, and most preferably not lower than 4.2 mPa·s.

As used herein, the 100° C. HTHS viscosity is a high-temperature, high-shear viscosity at 100° C. as provided in ASTM D4683. A 100° C. HTHS viscosity of less than 3.5 mPa·s may cause insufficient lubricity, whereas a 100° C. HTHS viscosity of over 5.3 mPa·s may not provide required low-temperature viscosity and sufficient energy-conserving performance.

The ratio of the 150° C. HTHS viscosity to the 100° C. HTHS viscosity (the 150° C. HTHS viscosity/the 100° C. HTHS viscosity) of the lubricant composition according to the present invention must be not less than 0.50, preferably not less than 0.51, more preferably not less than 0.52, particularly preferably not less than 0.53, and most preferably not less than 0.54. At less than 0.50, required low-temperature viscosity and sufficient energy-conserving performance may not be provided.

The lubricant composition according to the present invention is excellent in energy-conserving performance, lubricity, and high-temperature detergency, and has remarkably reduced 40° C. and 100° C. kinematic viscosity and 100° C. HTHS viscosity, which affect improvement in fuel efficiency, with the HTHS viscosity being maintained at a certain level, even if synthetic oils, such as poly-α-olefin base oils or ester base oils, or low-viscosity mineral base oils, are not used. The lubricant composition according to the present invention having such excellent properties may suitably be used as an energy-conserving engine oil, such as an energy-conserving gasoline or diesel engine oil.

The present invention will now be explained in more detail with reference to Examples and Comparative Examples, but the following Examples are illustrative only and do not in any way limit the present invention.

EXAMPLES 1 TO 4 AND COMPARATIVE EXAMPLES 1 TO 5

In Examples 1 to 4 and Comparative Examples 1 to 5, lubricant compositions having the compositions as shown in Table 2 were prepared, using the base oils and additives shown below, and evaluated as will be discussed below. The properties of base oils 1, 2, and 3 are shown in Table 1.

<Base Oil>

Base oil 1: mineral oil obtained by hydrocracking/hydroisomerizing n-paraffin-containing oil Base oil 2: hydrocracked base oil Base oil 3: hydrocracked base oil <Additives>

A-1 (viscosity index improver): polymethacrylate of PSSI=20, $M_w$=400000, and $M_w$/PSSI=2×10$^4$ (a dispersant type polymethacrylate additive obtained by polymerization of 90 mol % in total of methylmethacrylate, dimethylaminoethylmethacrylate, and methacrylate of formula (2) mentioned above wherein $R^2$ stands for an alkyl group having 12 to 20 carbon atoms, and 10 mol % of methacrylate of formula (2) wherein $R^2$ stands for a branched alkyl group having 22 carbon atoms)

A-2 (viscosity index improver): polymethacrylate of PSSI=40, $M_w$=300000, $M_w$/PSSI=0.75×10$^4$ (a dispersant type polymethacrylate additive containing, as major structural units, methylmethacrylate, methacrylate of formula (3) mentioned above wherein $R^4$ stands for a straight alkyl group having 12 carbon atoms, methacrylate of formula (3) wherein $R^4$ stands for a straight alkyl group having 13 carbon atoms, methacrylate of formula (3) wherein $R^4$ stands for a straight alkyl group having 14 carbon atoms, methacrylate of formula (3) wherein $R^4$ stands for a straight alkyl group having 15 carbon atoms, and dimethylaminoethyl methacrylate)

B-1 (friction modifier 1): glycerine monooleate

B-2 (friction modifier 2): oleyl urea

B-3 (friction modifier 3): molybdenum dithiocarbamate

C-1 (other additives): metal detergents, ashless dispersants, anti-oxidants, phosphorus anti-wear agents, pour point depressants, foam inhibitors, and the like

TABLE 1

| | | Base oil 1 | Base oil 2 | Base oil 3 |
|---|---|---|---|---|
| Urea adduct value | mass % | 1.3 | 4.6 | 5.5 |
| Density (15° C.) | g/cm$^3$ | 0.820 | 0.839 | 0.845 |
| Kinematic (40° C.) | mm$^2$/s | 15.8 | 18.7 | 35.91 |
| viscosity (100° C.) | mm$^2$/s | 3.85 | 4.09 | 6.379 |
| Viscosity index | | 141 | 120 | 130 |
| Pour point | ° C. | −22.5 | −22.5 | −17.5 |
| Aniline point | ° C. | 118.5 | 111.6 | 121.3 |
| Iodine value | | 0.06 | 0.79 | 5.3 |
| Sulfur content | mass ppm | <1 | 2 | 6 |
| Nitrogen content | mass ppm | <3 | <3 | <3 |
| NOACK evaporation loss | | 7.5 | 16.1 | 6.8 |
| n-d-M analysis | % CP | 93.3 | 78 | 78.4 |
| | % CN | 6.7 | 20.7 | 21.1 |
| | % CA | 0 | 1.3 | 0.5 |
| Chromatographic separation (mass %) | saturated components | 99.6 | 95.1 | 93.3 |
| | aromatics | 0.2 | 4.7 | 6.6 |
| Paraffin content based on saturated components | mass % | 87 | 51 | 49 |
| naphthene content based on saturated components | mass % | 13 | 49 | 51 |

<Evaluation of Lubricant Composition>

The lubricant compositions of Examples 1 to 4 and Comparative Examples 1 to 5 were measured of the 40° C. and the 100° C. kinematic viscosity, the viscosity index, the 100° C. and the 150° C. HTHS viscosity, the −35° C. CCS viscosity, and the amount of deposit in the panel coking test. The measurements were made in accordance with the following evaluation methods. The results are shown in Table 2.

(1) Kinematic viscosity: ASTM D-445

(2) Viscosity index: JIS K 2283-1993

(3) HTHS viscosity: ASTM D4683

(4) CCS viscosity: ASTM D5293

(5) Detergency test: Using a panel coking test apparatus, the test was run at an oil temperature of 100° C., panel temperature of 280° C., duration of splashing of 3 hours, and ON/OFF cycle of 15 s/45 s, and the amount of deposit (mg) on the panel was measured.

TABLE 2

| | | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 |
|---|---|---|---|---|---|---|---|---|---|---|---|
| | based on total amount of base oil | | | | | | | | | | |
| | Base oil 1 | mass % | 80 | 70 | 80 | 70 | 0 | 70 | 49 | 80 | 0 |
| | Base oil 2 | mass % | 0 | 0 | 0 | 20 | 100 | 30 | 0 | 0 | 100 |
| | Base oil 3 | mass % | 20 | 30 | 20 | 10 | 0 | 0 | 51 | 20 | 0 |
| | Base oil viscosity (100° C.) | mm$^2$/s | 4.2 | 4.4 | 4.2 | 4.1 | 4.1 | 3.9 | 5.0 | 4.2 | 4.1 |
| Additives | based on total amount of composition | | | | | | | | | | |
| A-1 | Polymethacrylate 1 | mass % | 10.1 | 9.4 | 10.2 | 10.8 | 10.7 | 11.4 | 6.5 | | |
| A-2 | Polymethacrylate 2 | mass % | | | | | | | | 4.6 | 4.8 |

TABLE 2-continued

| | | | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 |
|---|---|---|---|---|---|---|---|---|---|---|---|---|
| B-1 | Friction modifier 1 | | mass % | 1 | 1 | | 1 | 1 | 1 | 1 | 1 | 1 |
| B-2 | Friction modifier 2 | | mass % | 0.3 | 0.3 | | 0.3 | 0.3 | 0.3 | 0.3 | 0.3 | 0.3 |
| B-3 | Friction modifier 3 | | mass % | | | 0.5 | | | | | | |
| C-1 | Other additives | | mass % | 13 | 13 | 13 | 13 | 13 | 13 | 13 | 13 | 13 |
| | Results of Evaluation | | | | | | | | | | | |
| Kinematic viscosity | | 40° | $mm^2/s$ | 32 | 33 | 32 | 31 | 33 | 30 | 35 | 37 | 41 |
| | | 100° C. | $mm^2/s$ | 7.5 | 7.5 | 7.5 | 7.5 | 7.7 | 7.5 | 7.5 | 8.4 | 8.8 |
| Viscosity index | | | | 217 | 211 | 219 | 223 | 214 | 229 | 190 | 212 | 202 |
| HTHS viscosity | | 100° C. | mPa · s | 4.8 | 4.9 | 4.8 | 4.7 | 4.8 | — | 5.4 | 5.3 | 5.4 |
| | | 150° C. | mPa · s | 2.6 | 2.6 | 2.6 | 2.6 | 2.6 | — | 2.6 | 2.6 | 2.6 |
| HTHS viscosity (150 ° C.)/HTHS viscosity (100° C.) | | | | 0.54 | 0.53 | 0.54 | 0.54 | 0.54 | — | 0.48 | 0.49 | 0.48 |
| CCS viscosity | | −35° C. | mPa · s | 4000 | 4400 | 4000 | 4100 | 6700 | — | 6500 | — | 6900 |
| Amount of deposit in detergency test | | | mg | 80 | 65 | 85 | 125 | 210 | 200 | — | — | — |

From Table 2, it is understood that the compositions of Examples 1 to 4, which contained a low-viscosity base oil having a 100° C. kinematic viscosity of not less than 1 and less than 5 $mm^2/s$, a high-viscosity base oil having a 100° C. kinematic viscosity of 5 to 200 $mm^2/s$, and a particular viscosity index improver, were excellent in viscosity-temperature characteristics, low-temperature viscosity characteristics, and high-temperature detergency. In contrast, the compositions of Comparative Examples 1 and 2, which did not contain a high-viscosity base oil having a 100° C. kinematic viscosity of 5 to 200 $mm^2/s$, were inferior in high-temperature detergency. The composition of Comparative Example 3, which contained too much of a high-viscosity base oil having a 100° C. kinematic viscosity of 5 to 200 $mm^2/s$, had a low viscosity index, and was inferior in viscosity-temperature characteristics and low-temperature viscosity characteristics. The compositions of Comparative Examples 4 and 5, which contained viscosity index improver (A-2) having a Mw/PSSI ratio out of the requirement, had a low viscosity index, and was inferior in viscosity-temperature characteristics.

The invention claimed is:

1. A lubricant composition comprising:

(A) a lubricant base oil consisting of, based on the total amount of said base oil, (A-i) 70 to 92 mass % of a lubricant base oil having a 100° C. kinematic viscosity of not less than 1 and less than 5 $mm^2/s$, and (A-ii) 8 to 30 mass % of a lubricant base oil having a 100° C. kinematic viscosity of 5.7 to 10 $mm^2/s$, and (B) a poly(meth)acrylate viscosity index improver having a weight average molecular weight of not less than 10000, and a ratio of the weight average molecular weight to a permanent shear stability index of not lower than $0.8\times10^4$, said viscosity index improver (B) having 1 to 70 mol % of one or more (meth)acrylate structural units represented by formula (I):

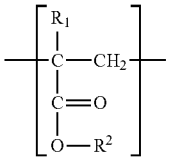

(1)

wherein $R^1$ stands for a hydrogen atom or a methyl group, and $R^2$ stands for a straight or branched hydrocarbon group having not less than 16 carbon atoms, wherein said composition comprises 0.1 to 50 mass % of said viscosity index improver (B) based on a total amount of the composition, and wherein said composition has a 100° C. kinematic viscosity of 3 to 15 $mm^2/s$, a viscosity index of 190 to 300, a 150° C. high-temperature, high shear viscosity (HTHS viscosity) of 2.0 to 2.8 mPa·s, and a ratio of a 150° C. HTHS viscosity to a 100° C. HTHS viscosity of not less than 0.51.

2. The lubricant composition according to claim 1, wherein said composition has a 150° C. HTHS viscosity of 2.6 to 2.8 mPa·s, and a 100° C. HTHS viscosity of not higher than 5.3 mPa·s.

3. The lubricant composition according to claim 1, wherein said viscosity index improver (B) consists essentially of said (meth)acrylate structural units represented by formula (1) and one or more (meth)acrylate structural units other than said (meth)acrylate structural units represented by formula (1).

* * * * *